US006400097B1

(12) United States Patent
Jin et al.

(10) Patent No.: US 6,400,097 B1
(45) Date of Patent: Jun. 4, 2002

(54) LOW WATTAGE FLUORESCENT LAMP

(75) Inventors: Feng Jin, Sagamore Hills; Thomas F. Soules, Richmond Heights; David Kachmarick, Strongsville, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,779

(22) Filed: Oct. 18, 2001

(51) Int. Cl.[7] ..... H05B 41/16

(52) U.S. Cl. ..... 315/246; 315/DIG. 2; 313/491; 313/489; 313/486

(58) Field of Search ..... 315/246, 291, 315/209 R, DIG. 2; 313/486, 489, 491, 110, 113, 563–565, 635–640

(56) References Cited

U.S. PATENT DOCUMENTS

| | | | | |
|---|---|---|---|---|
| 3,780,329 A | | 12/1973 | Otsuka et al. | 313/185 |
| 3,780,330 A | | 12/1973 | Otsuka et al. | 313/185 |
| 4,583,026 A | | 4/1986 | Kajiwara et al. | 315/226 |
| 4,698,547 A | * | 10/1987 | Grossman et al. | 313/156 |
| 4,940,918 A | * | 7/1990 | Rutfield | 313/487 |
| 5,008,789 A | * | 4/1991 | Arai et al. | 313/112 |
| 5,051,653 A | * | 9/1991 | DeBoer et al. | 313/487 |
| 5,142,191 A | * | 8/1992 | Blaisdell et al. | 313/488 |
| 5,210,461 A | * | 5/1993 | Pai et al. | 313/491 |
| 5,552,665 A | * | 9/1996 | Trushell | 313/112 |
| 5,602,444 A | * | 2/1997 | Jansma | 313/486 |
| 5,686,795 A | * | 11/1997 | Sakoske et al. | 313/242 |
| 5,838,100 A | | 11/1998 | Jansma | 313/485 |
| 5,898,265 A | * | 4/1999 | Woodward et al. | 313/486 |
| 6,137,217 A | * | 10/2000 | Pappalardo et al. | 313/467 |

FOREIGN PATENT DOCUMENTS

EP 0 131 965 A2 7/1984

* cited by examiner

*Primary Examiner*—Haissa Philogene
(74) *Attorney, Agent, or Firm*—Pearne & Gordon LLP

(57) ABSTRACT

A low-wattage mercury vapor discharge fluorescent lamp is provided for use with existing 110V high frequency electronic ballasts. The lamp has a discharge sustaining fill gas of mercury vapor and an inert gas that does not require a starting aid. The inert gas has 40–100 vol. % krypton, balance argon, and the fill gas has a total pressure of 0.5–3 torr. The phosphor layer has a coating weight of 2.3–4.3 mg/cm$^2$.

20 Claims, 2 Drawing Sheets

LOW WATTAGE FLUORESCENT LAMP

BACKGROUND OF INVENTION

1. Field of the Invention

The present invention relates generally to a fluorescent lamp, and more particularly to a low wattage fluorescent lamp adapted to function with high frequency electronic ballasts already present in the marketplace.

2. Description of Related Art

T8 fluorescent lamps have become quite popular, and have largely supplanted the previous generation T12 fluorescent lamps due to their inherent higher efficiency. A typical 4-foot T8 fluorescent lamp using the known three component rare earth phosphor blends operates on the IES reference circuit at 32.5 watts (W) and All produces 2850 lumens or about 88 lumens/watt. On high frequency commercial electric ballasts, efficiencies are significantly higher.

It is desirable to improve the energy efficiency of T8 fluorescent lamps to consume less energy. Because lighting applications employing T8 lamps account for a significant portion of total energy consumption, an improved energy efficient T8 lamp will significantly reduce total energy consumption. Reduced energy consumption translates into cost savings to the consumer as well as reduced environmental impact associated with excess energy production necessary to meet current needs.

Consequently, there is a need for a low-wattage T8 fluorescent lamp having equivalent lumen output compared with standard T8 fluorescent lamps. One method of improving lumen efficiency is to add krypton to the fill gas of a fluorescent lamp. Unfortunately, the addition of krypton (especially beyond 40 vol. %) typically creates other problems, namely difficulty in lamp starting and lamp striations.

It is desirable to provide a fluorescent lamp that has a high proportion of krypton in the fill gas (i.e. greater than 40 vol. %) to achieve high lumen efficiency, wherein difficulty in lamp starting and striations are totally or substantially eliminated.

SUMMARY OF INVENTION

A low pressure mercury vapor discharge lamp is provided having a light-transmissive glass envelope having an inner surface, a pair of spaced electrodes, a phosphor layer coated adjacent the inner surface of the glass envelope, and a discharge-sustaining fill gas of mercury vapor and inert gas sealed inside the envelope. The inert gas has 40–100 vol. % krypton with the balance argon, and the total pressure of the fill gas inside the glass envelope is 0.5–3 torr at 25° C. The lamp has a lumen efficiency of at least 80 lumens/watt.

A low-wattage lighting system is also provided having a mercury vapor discharge fluorescent lamp and a ballast. The ballast is adapted to electrically couple to the lamp, and the ballast has a striation killing electronic circuit. The ballast has a starting voltage of at least 500 volts. The lamp has a light-transmissive glass envelope having an inner surface, a pair of spaced electrodes, a phosphor layer coated adjacent the inner surface of the glass envelope, and a discharge-sustaining fill gas of mercury vapor and inert gas sealed inside the envelope. The inert gas has 40–100 vol. % krypton with the balance argon, and the total pressure of the fill gas inside the glass envelope is 0.5–3 torr at 25° C. The lamp has a lumen efficiency of at least 80 lumens/watt.

DETAILED DESCRIPTION

In the description that follows, when a range, such as 5 to 25 (or 5–25), is given, this means preferably at least 5, and separately and independently, preferably not more than 25.

As used herein, "electronic ballast" means a high frequency electronic ballast as known in the art, comprising a light weight solid state electronic circuit adapted to convert an AC input signal, into a high frequency AC output signal in the range of 20–150, preferably 20–100, preferably 20–80, preferably 20–50, preferably 25–40, kHz, and having an output voltage in the range of 150–1000V. The electronic ballast preferably is an instant-start ballast and is adapted to operate a T8 fluorescent lamp as known in the art. Less preferably, the ballast can be a rapid-start ballast as known in the art.

Also as used herein, a "T8 fluorescent lamp" is a fluorescent lamp as known in the art, preferably linear, preferably 48 inches in length, and having a nominal outer diameter of 1 inch (eight times ⅛ inch, which is where the "8" in "T8" comes from). Less preferably, the T8 fluorescent lamp can be nominally 2, 3, 6 or 8 feet in length. Alternatively, a T8 fluorescent lamp may be nonlinear, for example circular or otherwise curvilinear, in shape.

A "T12 fluorescent lamp" is a linear fluorescent lamp as known in the art having a nominal outer diameter of 1.5 inches and a similar set of lengths as the T8 lamps.

As used herein, wattages are as measured on the standard IES 60 Hz rapid start reference circuit known in the art. Also as used herein the term "wt. %" means percent by weight and the term "vol. %" means percent by volume (i.e. of a gas).

Figure 1:
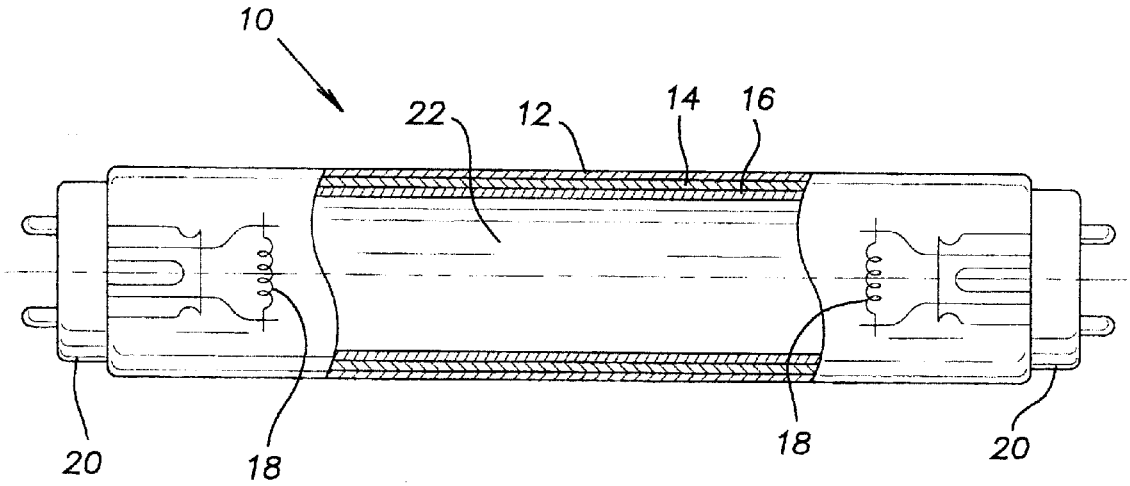
FIG. 1 shows a representative low pressure mercury vapor discharge lamp according to the present invention.

FIG. 1 shows a low pressure mercury vapor discharge fluorescent lamp 10 according to the present invention. The fluorescent lamp 10 has a light-transmissive glass tube or envelope 12 which has a circular cross-section. The glass envelope 12 preferably has an inner diameter of 2.37 cm, and a length of 118 cm, though the glass envelope may optionally have a different inner diameter or length. Preferably, an ultraviolet (UV) reflecting barrier layer 14 as known in the art is coated adjacent the inner surface of the glass envelope 12. Preferably, barrier layer 14 comprises a mixture of alpha- and gamma-alumina particles. Preferably, barrier layer 14 is in direct contact with the inner surface of glass envelope 12. The inner surface of the barrier layer 14 is coated with a phosphor layer 16. Less preferably, phosphor layer 16 can be coated directly on the inner surface of glass envelope 12 with no interposing barrier layer. Phosphor layer 16 is preferably a rare earth phosphor layer, such as a rare earth triphosphor layer.

Optionally phosphor layer 16 can be a halophosphate phosphor layer, which would produce lower lumens but still achieve the lower wattage according to the invention.

The lamp is hermetically sealed by bases 20 attached at both ends, and a pair of spaced electrode structures 18 are respectively mounted on the bases 20. A discharge-sustaining fill gas 22 of mercury vapor and an inert gas is sealed inside the glass tube. The inert gas is preferably a mixture of argon and krypton according to the present invention. The inert gas and a small quantity of mercury (preferably 0.002–0.015, preferably 0.003–0.01, preferably 0.004–0.006, torr mercury vapor pressure at 25° C.) provide the low vapor pressure manner of operation.

The phosphor layer 16 preferably comprises a mixture of red, green and blue emitting rare earth phosphors, preferably a triphosphor mixture. The red emitting phosphor is preferably yttrium oxide activated with europium ($Eu^{3+}$), commonly abbreviated YEO.

The green emitting phosphor is preferably lanthanum phosphate activated with cerium ($Ce^{3+}$) and terbium ($Tb^{3+}$), commonly abbreviated LAP. Less preferably the green emitting phosphor can be cerium, magnesium aluminate activated with terbium ($Tb^{3+}$), commonly abbreviated CAT, less preferably gadolinium, magnesium pentaborate activated with cerium ($Ce^{3+}$) and terbium ($Tb^{3+}$), commonly abbreviated CBT, less preferably any other suitable green emitting phosphor as known in the art.

The blue emitting phosphor is preferably calcium, strontium, barium chlorophosphate activated with europium ($Eu^{2+}$), less preferably barium, magnesium aluminate activated with europium ($Eu^{2+}$), less preferably any other suitable blue emitting phosphor known in the art. The three triphosphor components are combined on a weight percent basis, as known in the art, to obtain preselected lamp colors. Typical lamp colors include those having correlated color temperatures (CCT) of nominally 3000K, nominally 3500K, nominally 4100K, nominally 5000K, and nominally 6500K, though the triphosphors may be beneficially combined in relative wt. % ratios to yield a lamp having other predetermined color temperatures. The color temperatures are preferably at least or not more than those set forth above, or preferably plus or minus 50K, 100K, 150K or 200K. The lamp colors preferably lie within two, three or four MPCD steps of the standard CIE colors corresponding to the above CCTs.

In a less preferred embodiment, rare earth phosphor blends comprising other numbers of rare earth phosphors, such as systems with 4 or 5 rare earth phosphors, may be used in the phosphor layer 16.

The general coating structure is disclosed in U.S. Pat. No. 5,602,444. This coating structure is known in the art. As disclosed in the "444 patent, the UV-reflective barrier layer 14 comprises a blend of gamma- and alpha-alumina particles coated on the inner surface of the glass envelope 12, and a phosphor layer 16 coated on the inner surface of the barrier layer 14.

The phosphor layer 16 of the present invention is preferably disposed on the inner surface of the UV-reflective barrier layer 14 and has a coating weight of preferably 2.3–4.3, more preferably 2.5–3.9, more preferably 2.7–3.7, more preferably 2.8–3.4, more preferably 2.9–3.2, more preferably about 3.0, $mg/cm^2$. This represents a significant increase in coating weight over certain prior art, e.g. U.S. Pat. Nos. 5,008,789, 5,051,653, and 5,602,444, where typical coating weights of approximately 1.2 and 1.7 $mg/cm^2$ have been employed, for example, in General Electric Company's well known STARCOAT™ SP and SPX type lamps respectively. A T8 fluorescent lamp according to the present invention, though nominally more costly due to material costs, consumes less energy to produce the same lumens when used in conjunction with existing electronic ballasts. Increased phosphor coating weight, in conjunction with the alumina barrier layer 14 as described above, results in greater than 99% absorption of all the UV radiation generated by the discharge, and subsequent conversion into visible light. This results in about a 3% increase in efficiency over existing high performance General Electric SPX lamps which are generally known in the art. Hence, fluorescent lamps of the present invention consume less energy to produce the same lumens due to improved lamp efficiency.

The inert gas of fill gas 22 preferably comprises a mixture of argon and krypton. Optionally, the inert gas can be 100% substantially pure krypton. The inert gas for standard T8 fluorescent lamps is argon. Inert gas mixtures of argon and krypton are generally known in the art for certain lamps. Such mixtures, for example, commonly have been used in low-wattage prior generation T12 lamps. The addition of krypton reduces energy consumption in fluorescent lamps because krypton, having a higher atomic weight than argon, results in lower electron scattering and heat conduction losses per unit length of the discharge. However, a major disadvantage of krypton is that it suppresses Penning effect ionization, thereby making the lamp difficult to start on a standard 110V ballast without a starting aid. Up till now, this has kept inert gas compositions in fluorescent lamps below 40 vol. % krypton absent a starting aid.

A common starting aid is a film of semi-conducting tin oxide doped with fluorine or antimony applied to the inner surface of the glass envelope 12 via spray pyrolysis. During starting, the discharge capacitively couples to the coating and current passes along the wall until the discharge itself becomes conducting. However, such a film requires an additional coating step and is difficult to apply correctly, thus contributing to increased manufacturing time and cost. Additionally, the starting aid film reduces lumen output by 1–2.5 percent. Hence, in lamps requiring a starting aid to counter the effect of krypton, energy cost savings is at least partially offset by reduced lumen output and the added cost of the starting aid. Previous generation low-wattage T12 lamps employing starting aids typically contain 75–90 percent krypton in the inert gas, balance argon. Such a high ratio of krypton contributes significantly to the difficulty in starting fluorescent lamps.

Nonetheless, a fluorescent lamp of the present invention can have even higher krypton levels (i.e. up to 100 vol. %) in the inert gas without a starting aid. The inert gas is 40–100, preferably 40–95, preferably 40–80, preferably 45–75, preferably 50–60, preferably 52–57, preferably about 55, vol. % krypton, balance argon. The total pressure of the fill gas 22 (including mercury vapor and inert gas) is preferably 0.53, more preferably 0.5–2.5, more preferably 0.5–2, more preferably 1–2, more preferably 1.32, more preferably 1.4–1.7, more preferably about 1.5, torr at 25° C.

Surprisingly and unexpectedly, it has been found that by reducing the total fill gas pressure to 0.5–3 torr at 25° C., improved lumen efficiency and easier lamp starting are achieved while striations are reduced or substantially eliminated in lamps having krypton levels up to 55 vol. % when used with conventional ballasts. Easy starting and substantial elimination of striations are also achieved in lamps having krypton levels up to 100 vol. % when used in conjunction with an invented ballast as described below. It has been observed that when striations do occur in an invented lamp, they exist only temporarily, e.g. for about or less than one minute after the lamp is started. For example, a 10% increase in lumen efficiency has been observed in invented lamps containing 40 vol. % krypton in the inert gas at a total fill gas 22 pressure of 1.5–1.9 torr compared to a typical 4" T8 lamp operated on a standard 60 Hz reference circuit. These invented lamps required no starting aid. Further, a 15% increase in lumen efficiency has been observed for an invented lamp having 95 vol. % krypton in the inert gas. Even higher lumen efficiencies, e.g. up to 20% increase over standard T8 lamps, have been achieved with commercial high frequency ballasts. A lamp having an inert gas composition and total fill gas pressure as described above reduces power consumption, yet requires no starting aid.

The invented lamp having high krypton content (e.g. 40–100 vol. %), and particularly those having 56–100, 60–100, 70–100, or 80–100, vol. % krypton in the inert gas, may experience difficult starting with certain existing ballasts present in the marketplace. When used with these certain ballasts, the invented lamp may also exhibit some striations. However, both of these effects are overcome by coupling the lamp with an invented ballast 50 to provide a low-wattage lighting system according to the invention.

Figure 2:
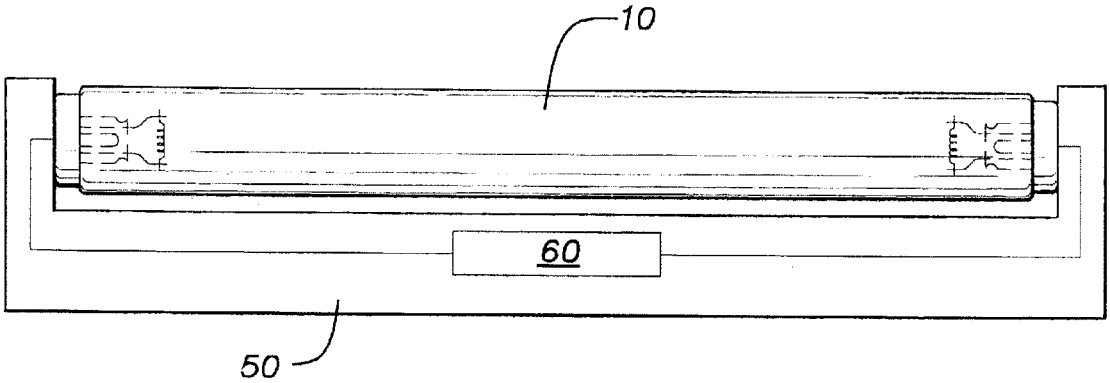
FIG. 2 shows a low-wattage lighting system according to the invention, having a fluorescent lamp as shown in FIG. 1 electrically coupled to an invented ballast having a striation-killing electronic circuit.

An invented low-wattage lighting system is shown in FIG. 2. The lighting system has a ballast 50 which is designed to couple to an invented lamp 10 having a high krypton content (e.g. 40–100 vol. % krypton). The ballast 50 has a high starting voltage and/or a high pulse voltage to facilitate starting. Preferably, the invented ballast 50 has a starting voltage of at least 500, preferably 530, preferably 550, preferably 600, preferably 650, preferably 700, volts. The invented ballast 50 preferably also includes a striation-killing electronic circuit 60 that distorts the higher frequency current wave form so as to eliminate striations altogether.

The invention will be understood, and particular aspects of the invention further described, in conjunction with the following examples.

EXAMPLE 1

A lamp having 55 vol. % krypton requires a starting voltage of approximately 530V. T8 fluorescent lamps according to the present invention having an inert gas of 55 vol. % krypton, balance argon, and total fill gas 22 pressures of 1.5 torr and 1.9 torr have been tested with several instant-start electronic ballasts common in the marketplace. A list of those ballasts tested is provided in Table 1 below.

TABLE 1

Common Instant-Start Electronic Ballasts Tested With Invented T8 Lamps Having 55 vol. % Krypton

| Manufacturer | Model |
|---|---|
| Power Lighting | E232P120L |
| Power Lighting | E232PI10OG01 |
| Magnetek | B232I120L |
| Magnetek | B232I120RH |
| Advance | REL 2P23-SC |
| Advance | REL 2P32-RH-TP |
| Advance | RCN 2P32-LW |
| Advance | RCE 2P32 |
| Motorola | M2-IL-T8-GP-D-120 |
| Motorola | M2-IN-T8-D-120 |
| Howard Industries | E2-32-IS-120 |
| Howard Industries | EP2-32IS-120-130 |
| Howard Industries | EL2-32IS-120 |

Satisfactory starting of the invented lamps was achieved on all of the above 110V electronic ballasts using the combination of argon-krypton ratio and total fill gas pressure as described above. No starting aid was required to achieve satisfactory starting with any of the tested ballasts. Consequently, a lamp according to the present invention can be employed in conjunction with, and is adapted to be effectively electrically coupled to, electronic ballasts already present in the marketplace, meaning that consumers can immediately begin using low-wattage fluorescent lamps in existing fluorescent lighting fixtures.

Invented lamps with still higher krypton content (e.g. up to 95 vol. % krypton) were also tested. These lamps generally were harder to start, but when operated in conjunction with an invented ballast 50, they exhibited similar lumens to standard T8 lamps at up to 20% increased lumen efficiency.

EXAMPLE 2

Low-wattage 4-foot T8 lamps according to the present invention were tested on the standard IES 60 Hz rapid start reference circuit The average performance of 20 such lamps was compared with that of 20 standard 4-foot T8 lamps on the same circuit. The results are shown below in Table 2. The power reported in table 2 is as measured on the standard 120V 60 Hz reference circuit.

TABLE 2

Comparison of Invented Fluorescent Lamps and Standard Fluorescent Lamps

| Lamp | Nominal Color Temp (K) | Gas Composition (vol. %) | Total Pressure (torr) | Coating Weight (mg/cm$^2$) | Power (W) | 100 Hour Lumens |
|---|---|---|---|---|---|---|
| Std T8 | 3500 | 100% Ar | 2.5 | 1.7 | 32.5 | 2931 |
| Invented T8 | 3500 | 55% Kr 45% Ar | 1.5 | 3.1 | 29.2 | 2923 |

As can be seen in Table 2, the invented T8 lamp consumed about 10% less power. The standard T8 lamp yielded about 92 lumens/watt while the invented T8 lamp yielded 100 lumens/watt. While the invented lamps resulted in a decrease in power consumption of about 10% when used in the standard reference circuit, it has been observed that the same lamps result in a decrease in power consumption of 10–15% when operated on typical commercial ballasts such as those listed in Table 1. The invented lamp preferably consumes at least 5, 6, 7, 8, 9, 10, 11, 12, 13, 14, 15, 16, 17, or 18 percent less power than a standard T8 lamp. Preferably, the invented lamp also yields at least 1, 2, 3, 4, 5, 6, 7, 8, 9, or 10, percent more lumens/watt than a standard T8 lamp. Similar reductions in wattage and increases in efficiency or efficacy (lumens/watt) are achieved by an invented lamp having any configuration, i.e. not just a T8 lamp, compared to a corresponding standard lamp known in the art. For example, variations in lamp diameter, length, color temperature, and other parameters are possible without deviating from the scope of the invention.

The invented low-wattage 4-foot linear T8 lamp preferably consumes not more than 30.9, 30.5, 30.2, 30, 29.9, 29.6, 29.2, 28.9, 28.6, 28.3, 28.0, 27.7, 27.4, 27, 26.6, 26.2, or 25.8 watts when operated on the reference 120V 60 Hz circuit.

A T8 fluorescent lamp-according to the present invention will have nominally identical color rendering index (CRI) characteristics compared to equivalent standard T8 lamps. Hence, the invented lamps can be employed in virtually all lighting applications where current T8 lamps are used, their CRI characteristics being similarly tunable through proper selection of triphosphor weight percent ratios in the phosphor layer 16. A lamp of the present invention preferably has a CRI of at least 50, preferably 60, preferably 70, preferably 75, preferably 80, preferably 85, preferably 90. The invented lamp preferably has an efficiency of at least 80, preferably 82, preferably 84, preferably 86, preferably 88, preferably 90, preferably 92, preferably 93, preferably 94, preferably 96, preferably 98, preferably 100, lumens/watt (as measured on the IES reference circuit mentioned above). The invented lamp preferably has a lumen output of at least 2700, 2750, 2800, 2850, or 2900, lumens, measured at 100 hours (100-hour lumens).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A low pressure mercury vapor discharge lamp comprising a light-transmissive glass envelope having an inner surface, a pair of spaced electrode structures, a phosphor layer coated adjacent said inner surface of said glass envelope, and a discharge-sustaining fill gas of mercury vapor and inert gas sealed inside said envelope, wherein said inert gas comprises 40–100 vol. % krypton, balance argon, and the total pressure of said fill gas inside said glass envelope is 0.5–3 torr at 25° C., said lamp having a lumen efficiency of at least 80 lumens/watt.

2. A lamp according to claim 1, further comprising an ultraviolet reflecting barrier layer disposed between said inner surface of said glass envelope and said phosphor layer, wherein said barrier layer comprises alumina particles.

3. A lamp according to claim 1, wherein said lamp has a total fill gas pressure of 0.5–2 torr at 25° C.

4. A lamp according to claim 1, wherein said phosphor layer comprises a blended triphosphor system of red, green, and blue color-emitting rare earth phosphors.

5. A lamp according to claim 1, wherein said lamp is a 4-ft linear T8 lamp and operates at a power of not more than 30.9 watts.

6. A lamp according to claim 5, wherein said lamp has an output of at least 2700 lumens.

7. A lamp according to claim 1, wherein said lamp has an output of at least 2800 lumens.

8. A lamp according to claim 1, wherein said lamp has a lumen efficiency of at least 93 lumens/watt.

9. A lamp according to claim 1, wherein said phosphor layer has a coating weight of 2.3–4.3 mg/cm$^2$.

10. A lamp according to claim 1, wherein said phosphor layer has a coating weight of 2.5–3.9 mg/cm$^2$.

11. A lamp according to claim 1, wherein said inert gas comprises 40–75 vol. % krypton, balance argon.

12. A lamp according to claim 1, wherein said fill gas sealed inside said envelope has a total pressure of 0.5–2.5 torr at 25° C.

13. A lamp according to claim 1, said lamp having a CRI of at least 50.

14. A lamp according to claim 1, said lamp having a CRI of at least 75.

15. A lamp according to claim 1, wherein said lamp is a T8 fluorescent lamp.

16. A lamp according to claim 1, wherein said lamp is a 4-foot T8 fluorescent lamp.

17. A lamp according to claim 1, wherein said lamp operates at a power of not more than 30 watts when operated on a 120V 60 Hz reference circuit.

18. A low-wattage lighting system comprising a mercury vapor discharge fluorescent lamp and a ballast, said ballast being adapted to electrically couple to said lamp, said ballast comprising a striation killing electronic circuit and having a starting voltage of at least 500 volts, said lamp comprising a light-transmissive glass envelope having an inner surface, a pair of spaced electrodes, a phosphor layer coated adjacent said inner surface of said glass envelope, and a discharge-sustaining fill gas of mercury vapor and inert gas sealed inside said envelope, wherein said inert gas comprises 40–100 vol. % krypton, balance argon, and the total pressure of said fill gas inside said glass envelope is 0.5–3 torr at 25° C., said lamp having a lumen efficiency of at least 80 lumens/watt.

19. A lighting system according to claim 18, wherein said lamp further comprises an ultraviolet reflecting barrier layer disposed between said inner surface of said glass envelope and said phosphor layer, said barrier layer comprising alumina particles.

20. A lighting system according to claim 18, wherein said inert gas comprises 50–100 vol. % krypton.

* * * * *